US006432201B1

(12) United States Patent
Klas et al.

(10) Patent No.: US 6,432,201 B1
(45) **Date of Patent: *Aug. 13, 2002**

(54) DEVICE FOR APPLYING A COATING SUBSTANCE TO A CONTINUOUS PAPER WEB

(75) Inventors: Ernst Klas, Siegburg; Gisbert Krossa, Wolfrath; Willi Erkelenz, Langenfeld; Heinz Mörtl; Udo Unger, both of Leichlingen, all of (DE)

(73) Assignee: Vits Maschinenbau GmbH, Langenfeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/646,760

(22) PCT Filed: Mar. 23, 1999

(86) PCT No.: PCT/EP99/01946

§ 371 (c)(1),
(2), (4) Date: Sep. 21, 2000

(87) PCT Pub. No.: WO99/50501

PCT Pub. Date: Oct. 7, 1999

(30) Foreign Application Priority Data

Mar. 31, 1998 (DE) ..... 198 14 212
Jun. 5, 1998 (DE) ..... 198 25 156

(51) Int. Cl.[7] ..... B05C 1/08

(52) U.S. Cl. ..... 118/200; 118/126; 118/259; 118/304; 118/410

(58) Field of Search ..... 118/57, 126, 259, 118/304, 410; 427/356

(56) References Cited

U.S. PATENT DOCUMENTS 3,373,071 A 3/1968 Fuerst
3,667,422 A * 6/1972 Saladin ..... 118/212
4,957,423 A * 9/1990 Yokoya ..... 118/259
6,231,670 B1 * 5/2001 Fischer et al. ..... 118/67

FOREIGN PATENT DOCUMENTS

| | | |
|---|---|---|
| DE | 195 08 797 C1 | 8/1996 |
| DE | 196 04 907 A1 | 8/1997 |
| DE | 196 43 742 A1 | 4/1998 |
| GB | 674 149 | 6/1952 |
| WO | wo 94/11116 | 5/1994 |

OTHER PUBLICATIONS

"Das Streichen Von Schachtelkarton" by Peters (Wochenblatt für Papierfabrikation Jun. 1973).

* cited by examiner

*Primary Examiner*—Laura Edwards
(74) *Attorney, Agent, or Firm*—Herbert Dubno

(57) ABSTRACT

The invention relates to a device for applying a coating substance to a continuous paper web in a process for producing abrasion-resistant laminates for manufacturing decorative paper. The coating substance consists of a viscous mixture of melamine resin and alphacellulose to which particles of corundum are added, and is applied to the visible surface of the paper. The inventive device includes a deflector roll (2) on which the paper web (1) lies in an area in which it loops around; a metering roll (6) which is arranged parallel to the deflector roll (2) and forms the boundary of a gap with the same, and which is driven synchronously or almost synchronously with the deflector roll; a slit nozzle (7) for applying the coating substance either directly to the paper web (1) on the deflector roll (2) or to the metering roll (6); and a doctor blade of a rectangular piece (9) of flexible rubber type material. This material is fixed on one side by its back edge, parallel to the axes of the two rolls (2,6) and lies loosely on the upper end of the paper web (1) running off of the deflector roll (2).

7 Claims, 2 Drawing Sheets

DEVICE FOR APPLYING A COATING SUBSTANCE TO A CONTINUOUS PAPER WEB

CROSS REFERENCE TO RELATED APPLICATIONS

This application is the US nation phase of PCT application PCT/EP99/01946 filed Mar. 1999 with a claim to the priority of German patent application 19814212.9 itself filed Mar. 31, 1998 German application 19825156.4 itself filed Jun. 5, 1998.

FIELD OF THE INVENTION

The invention relates to a device for applying a coating substance, comprised of a liquid resin and a fine-grained abrasive material, especially corundum, to a continuous paper web for use in the production of wear-resistant laminates.

BACKGROUND OF THE INVENTION

DE 95 08 797 C1 describes a process for producing decorative paper for use in the production of wear-resistant laminates. For this purpose, a viscous mixture of melamine resin and alpha cellulose to which corundum particles have been added is deposited as a coating substance on the visible surface of a decorative paper.

The alpha cellulose serves, therefore, as a stiffening and suspending agent. The corundum particles have a grain size of 15 to 50 $\mu$m. The coating quantity amounts to 80 to 200 g/m$^2$ so that, after attaining the final moisture content, the layer thickness is 20 to 60 $\mu$m. The coating substance should be applied by means of a wire doctor element, a reverse coating system or a screen roller.

It has been found in practice that any moving parts of such coating substance which come into contact with the coating substance are worn out in very brief periods of time by the abrasive corundum.

In the submission of H. Peters which appeared in the journal "Weakly for paper fabrication", 6, 1973, p. 164 to 169, a nozzle coating system, inter alia, has been briefly described. In that system, a slit nozzle is trained from below on a lower region of a continuous cardboard web which is looped around a rotating roller in a hairpin shape. Downstream of the nozzle, in the movement direction, a doctor blade is arranged to smooth out the applied layer and for removal of surplus coating substance. From this publication one learns that the coating device is suitable for coating quantities up to 25 to 30 g/m$^2$ and is especially advantageous at high speeds.

OBJECTS OF THE INVENTION

It is the object of the invention to provide a device for applying a coating substance comprised of liquid resin and fine-grained abrasive material, especially corundum, to a continuous paper web which satisfies the following requirements:

On the one hand, the coating substance should be applicable in a relatively thick uniform layer as is required for papers which are intended for the production of abrasion-resistant laminates, especially with a coating quantity of 80 to 200 g/m$^2$.

On the other hand, the device should largely avoid the need for expensive machine components which are subject to excessive wear by the abrasive particle.

This object is attained with the device of applying a liquid resin and fine-grained abrasive material, especially corundum onto a continuous paper web for use in the production of abrasion resistant laminates. The device according to the invention is provided with a deflecting roller on which the paper web lies in a looping region, with a metering roller which is arranged parallel to the deflecting roller and includes a narrow gap therewith and is driven synchronously or approximately synchronously with the deflecting roller, with a slit nozzle for applying the coating substance either directly to the paper web lying on the deflecting roller or to the metering roller, and with a doctor blade comprised substantially of a rectangular flap of a flexible rubber like material which is affixed at its rear edge parallel to the axes of the two rollers and which lies slackly on the upper pass departing from the deflecting roller of the paper web.

The uniformity of the applied coating is still further improved by affixing the flap to a support bar which is set into vibration.

The slit nozzle is oriented from above onto the metering roller to allow the coating substance which is applied to the metering roller to be more readily observable. This simplifies the predosing. Since in this arrangement the nozzle slit lies below, the device can be operated with lower pump pressures. The settling of particles in the nozzle is completely avoided.

When the slit nozzle is offser reative to the zenith line of the metering roller in the direction of rotation of the metering roller it is possible to avoid running of the coating substance into the roller gap upon standstill of the machine and smearing of the deflecting roller.

BRIEF DESCRIPTION OF THE DRAWINGS

The drawing serves to illustrate the invention based upon embodiments schematically illustrated in FIGS. 1 to 3.

SPECIFIC DESCRIPTION

Figure 1:
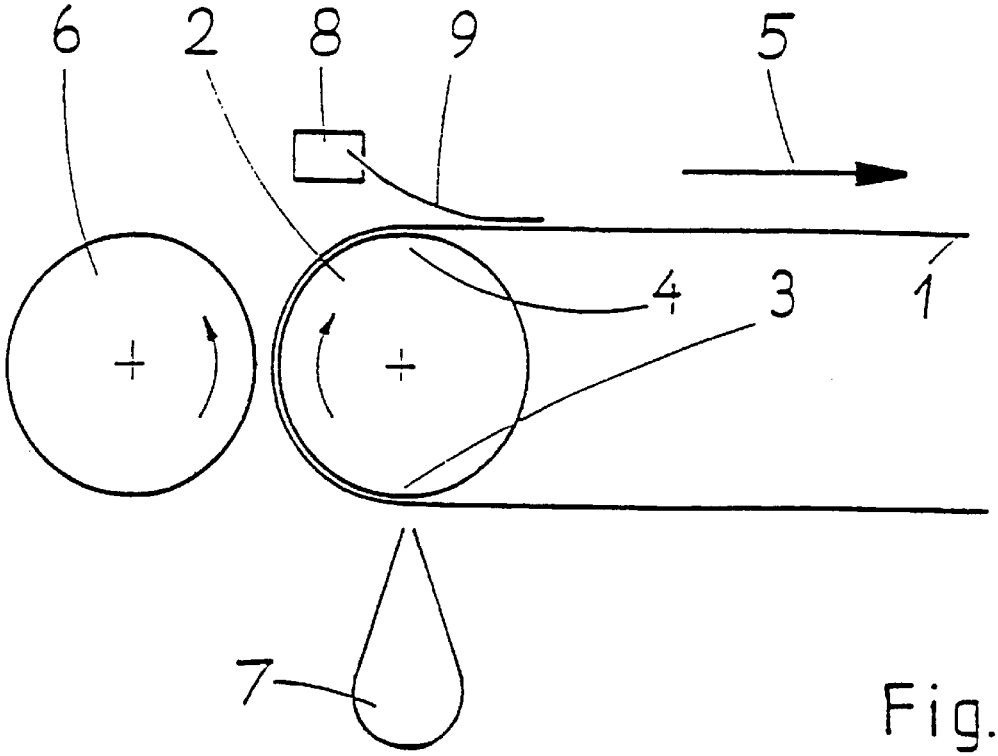

A paper web 1, which is already preimpregnated with resin and optionally has already been dried, is fed according to FIG. 1 in a horizontal direction beneath a deflecting roller 2. It is looped around the deflecting roller 2 to form an arc through 180° which is bounded on one side by an approach line 3 and on the other side by a departure line 4. Then it runs in a horizontal direction as is symbolized by arrow 5 to a drier that is not shown.

A metering roller 6 is arranged adjacent the deflecting roller 2 and has a smooth roller surface. It has in this embodiment the same diameter as the deflecting roller 2. The axes of the deflecting roller 2 and trhe metering roller 6 are journaled in a machine frame parallel to one another at the same level. The bearings of one of the two rollers 2 and 6 are journaled in a machine frame parallel to one another at the same level. The bearings of one of the two rollers 2 and 6 are shiftable parallel to the horizontal direction so that the width of the narrow gap between the two rollers 2 and 6 can be varied. The metering roller 6 like the deflecting roller 2 is provided with a drive. The drives for the two rollers 2 and 6 can be mechanically or electrically coupled so that the rollers 2 and 6 run synchronously or approximately synchronously.

Below the deflecting roller 2, a slit nozzle 7 is arranged for applying the coating substance. The nozzles's slit is adjacent the approach line 3.

Above the deflecting roller 2 a support bar 8 parallel to the axes of the two rollers 2 and 6 is connected with the machine frame. On the support bar 8, the rearward edge of a rectangular flap 9 extending in the direction of the arrow 5 and formed of a flexible rubber-like material is affixed, the flap extending over the full working width, i.e. the width of the coated paper web 1. The remaining edges of the rectangular flap 9 are free. The flap 9 lies like a slack strip over its part opposite the support bar 8 on the upper pass of the paper web 1 travelling awat from the defecting roller 2 in the region of the departure line 4. The length of the flap 9—in the direction of the arrow 5—is about between 5 and 50 cm, preferably between about 10 and 30 cm. The flap 9 is approximately 2 to 5 mm thick.

In operation, the paper web 1 travels with a speed between about 10 and 70 m/min, preferable between 20 and 50 m/min. With the slit nozzle 7, the coating substance is coated from below onto the paper web 1 in excess, the coating substance consisting of liquid resin and fine corundum particles suspended therein. The thus applied layer is split in the narrow gap between the deflecting roller 2 and the metering roller 6 so that a part of the coating substance remains adherent to the paper web 1, another part being entrained by the metering roller 6. Surplus coating substance is dammed up in the gap and drops down. Since the surface speeds fo the two rollers 2 and 6 are at least approximately the same, the abrasive particles contained in the coating mass do not noticeably wear on the metering rolller 6.

The layer adherent to the paper web 1, on an average about 80 to 200 g/m$^2$ is initially nonuniform so that longitudinal strips are clearly visible. Their widths amount as a rule to about 5 mm. The spacing of the strips from one another is at most between about 10 and 30 mm. The undesired strip pattern changes in an unpredictable way. It is easily equalized by the flap 9 which presses with friction against the paper web 1 lightly so that such strips practically no longer arise. In a stationary state none of the coating substance is thereby stripped away. The flap 9 thus has only a comparatively minor effect and does not act as a metering element. It is naturally engaged by the abrasive particles and must thus be replaced from time to time. This replacement is relatively simple and does not contribute to any significant cost.

Figure 2:
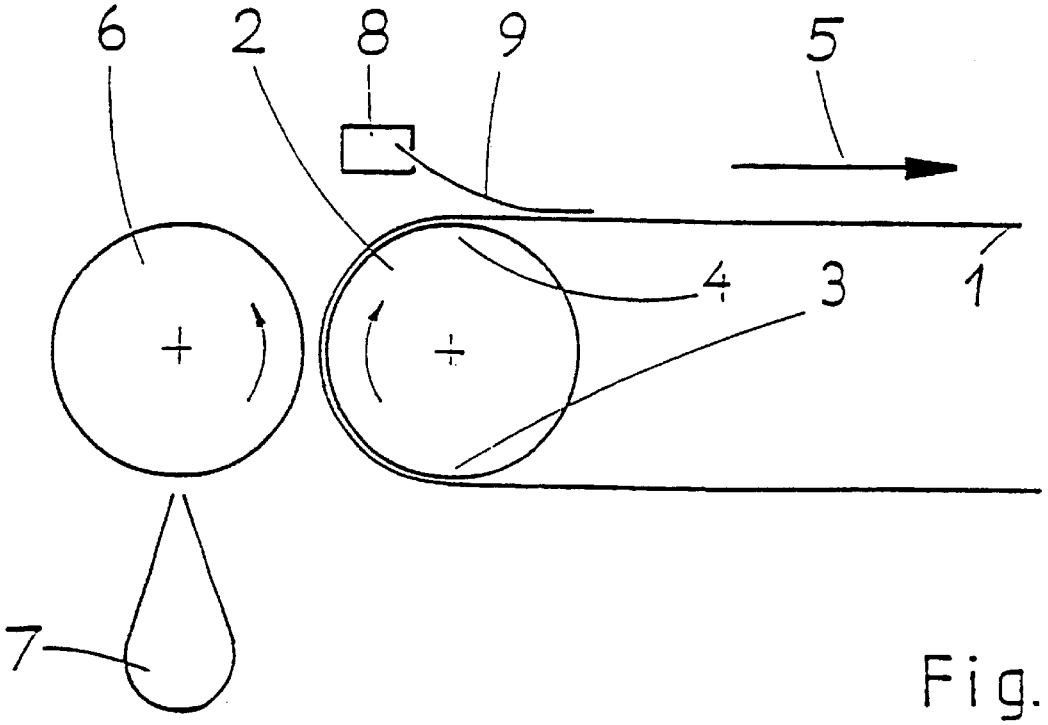

The embodiment of FIG. 2 differs from the aforedescribed embodiment especially in that the slit nozzle 7 is trained ont he surface of the metering rollr 6. The coating substance deposited on the metering roller 6 is transferred in the gap between the two rollers 2 and 6 to pass partly onto the paper web 1. The two embodiments otherwise are in agreement with one another such that further explanation of FIG. 2 is superfluous.

Figure 3:
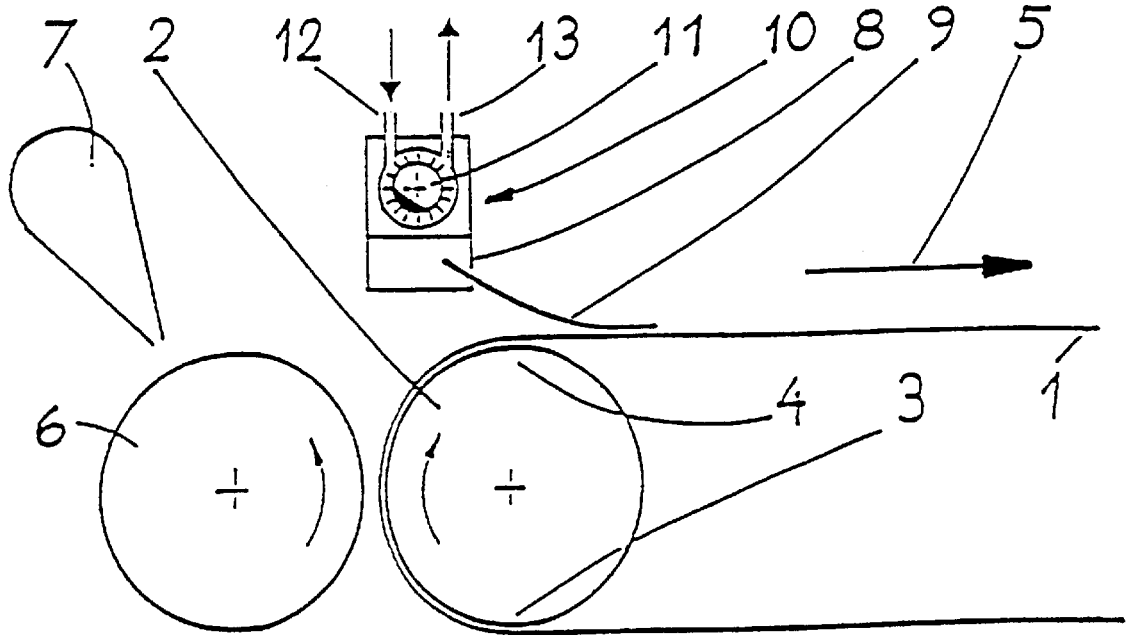

In the embodiment shown in FIG. 3, the slit nozzle 7 is arranged above the metering nozzle 6 so that the coating substance is applied from above. It is somewhat offset from the zenith line of the metering roller 6 in the rotational direction. In the drawing it is located substantially in the eleven o'clock position.

The support bar 8 is bendable or connected by yieldable fastening elements with the machine frame (not shown) so that it can make small movements relative to the machine frame. On the support bar 8 there is mounted a compressed-air turbine vibrator 10. It is comprised mainly of a block-shaped housing with a cylindrical hollow in which a rotor 11 is rotationally journaled so that its axis of rotation is oriented parallel to the support bar 8. It is provided with an eccentric weight symbolically shown in the drawing by a black color sector. On the surface of the rotor 11 there are radial ribs comparable to the blades of a Pelton turbine. Two passages 12 and 13, whose axes are tangential to the rotor 11, open on opposite sides in the interior of the vibrator 10. The passage 12 is connected with a compressed-air source. The passage 13 is the outlet for the discharge air and is optionally provided with a sound damper that is not shown.

In operation, the vibrator 10 is supplied via the passage 12 with compressed air. As a consequence, the rotor 11 is set into rotation, Because of the ecxcentric weighing of the rotor 11, circular oscillations are generated and transmitted to the support bar 8. The flap 9 is therby set into vibration. The frequency of vibration is determined by the pressure of the supplied air which lies preferably between 100 and 200 Hz.

Suprisingly, it has been found that the equalizing effect of the flap is significantly improved by the vibrations.

Elements for premetering or smoothing the coating substance entrained by the metering roller 6 are not provided along the path between the slit nozzle 7 and the gap between the two rollers 2 and 6.

What is claimed is:

1. A device for applying a coating substance consisting essentially of a liquid resin and fine-grained abrasive material onto a continuous paper web for use in the production of an abrasion-resistant laminate, the device comprising:

a deflecting roller rotatable about an axis and over which the paper web passes in a travel direction in a looping region;

a metering roller forming a gap with the deflecting roller at the looping region and rotatable about an axis generally parallel to the deflecting-roller axis;

means for generally synchronously rotating the deflecting roller and metering roller about the respective axes;

means including a slit nozzle adjacent the rollers for applying the coating substance to the paper web in the looping region; and a generally rectangular flap of a flexible rubber-like material having a rear edge fixed generally parallel to the axes adjacent the two rollers and lying slackly on the web downstream in the travel direction of the region.

2. The coating-applying device defined in claim 1, further comprising a support bar which extends generally parallel to the axes and to which the flap rear edge is secured; and means for vibrating the support bar.

3. The coating-applying device defined in claim 2 wherein the support is vibrated in a direction perpendicular to the support bar.

4. The coating-applying device defined in claim 3 wherein the vibrating means includes a rotating eccentric weight.

5. The coating-applying device defined in claim 3 wherein the vibrating means includes a compressed-air turbine.

6. The coating-applying device defined in claim 1 wherein the slit nozzle is oriented above and directed downward onto the metering roller.

7. The coating-applying device defined in claim 5 wherein the slit nozzle is offset upstream in the travel direction to an uppermost portion of the metering roller.

* * * * *